US008926402B2

(12) United States Patent
Nakanishi et al.

(10) Patent No.: US 8,926,402 B2
(45) Date of Patent: Jan. 6, 2015

(54) METHOD OF POLISHING A SUBSTRATE USING A POLISHING TAPE HAVING FIXED ABRASIVE

(75) Inventors: Masayuki Nakanishi, Tokyo (JP); Masaya Seki, Tokyo (JP); Kenji Kodera, Kanagawa (JP)

(73) Assignee: Ebara Corporation, Tokyo (JP)

( * ) Notice: Subject to any disclaimer, the term of this patent is extended or adjusted under 35 U.S.C. 154(b) by 394 days.

(21) Appl. No.: 13/303,485

(22) Filed: Nov. 23, 2011

(65) Prior Publication Data

US 2012/0135668 A1 May 31, 2012

(30) Foreign Application Priority Data

Nov. 26, 2010 (JP) ..... 2010-263215

(51) Int. Cl.

| | |
|---|---|
| ***B24B 1/00*** | (2006.01) |
| ***B24B 9/06*** | (2006.01) |
| ***B24B 21/00*** | (2006.01) |
| ***B24B 37/02*** | (2012.01) |

(52) U.S. Cl.

CPC ..... *B24B 9/065* (2013.01); *B24B 21/002* (2013.01); *B24B 37/02* (2013.01)

USPC ..... 451/44; 451/81; 451/296

(58) Field of Classification Search

USPC ..... 451/28, 41, 43, 44, 59, 81, 167, 168, 451/296

See application file for complete search history.

(56) References Cited

U.S. PATENT DOCUMENTS

| | | | | |
|---|---|---|---|---|
| 3,524,284 | A * | 8/1970 | Mears | 451/303 |
| 4,109,422 | A * | 8/1978 | Parsons | 451/56 |
| 5,733,181 | A * | 3/1998 | Hasegawa et al. | 451/168 |
| 5,868,857 | A * | 2/1999 | Moinpour et al. | 134/6 |
| 6,402,596 | B1 * | 6/2002 | Hakomori et al. | 451/44 |
| 6,447,374 | B1 * | 9/2002 | Sommer et al. | 451/56 |
| 6,485,355 | B1 | 11/2002 | Economikos et al. | |
| 6,558,239 | B2 * | 5/2003 | Kunisawa et al. | 451/303 |
| 7,014,529 | B1 * | 3/2006 | Kubota et al. | 451/7 |
| 7,744,445 | B2 * | 6/2010 | Kubota et al. | 451/41 |
| 8,152,598 | B2 * | 4/2012 | Fukushima et al. | 451/11 |

(Continued)

FOREIGN PATENT DOCUMENTS

| | | |
|---|---|---|
| JP | 11-033890 | 2/1999 |
| JP | 2000-173955 | 6/2000 |

(Continued)

OTHER PUBLICATIONS

PAJ and Machine Translation of JP 2009-238818 issued Oct. 15, 2009 (previously submitted with IDS on Aug. 15, 2014).

(Continued)

*Primary Examiner* — Lee D Wilson
*Assistant Examiner* — Tyrone V Hall, Jr.
(74) *Attorney, Agent, or Firm* — Wenderoth, Lind & Ponack, L.L.P.

(57) ABSTRACT

A method of polishing a peripheral portion of a substrate is provided. This method includes: causing sliding contact between the peripheral portion of the substrate and a polishing tape; and supplying a polishing liquid onto the polishing tape contacting the peripheral portion of the substrate. The polishing tape includes a base tape and a fixed abrasive formed on the base tape, and the polishing liquid is an alkaline polishing liquid containing an alkaline chemical and an additive including molecules that cause steric hindrance.

19 Claims, 17 Drawing Sheets

(56) References Cited

U.S. PATENT DOCUMENTS

| | | | | |
|---|---|---|---|---|
| 2001/0051432 | A1 | 12/2001 | Yano et al. | |
| 2004/0106363 | A1 | 6/2004 | Ishii et al. | |
| 2005/0250423 | A1 | 11/2005 | Nakamura et al. | |
| 2008/0207093 | A1 | 8/2008 | Ko et al. | |
| 2008/0287038 | A1 | 11/2008 | Miyabe et al. | |
| 2009/0004952 | A1* | 1/2009 | Takahashi et al. | 451/44 |
| 2009/0142992 | A1 | 6/2009 | Takahashi et al. | |
| 2010/0112909 | A1* | 5/2010 | Yamaguchi et al. | 451/44 |
| 2010/0178851 | A1 | 7/2010 | Nakanishi et al. | |

FOREIGN PATENT DOCUMENTS

| | | |
|---|---|---|
| JP | 2001-345294 | 12/2001 |
| JP | 2003-163188 | 5/2003 |
| JP | 2004-103825 | 4/2004 |
| JP | 2008-036784 | 2/2008 |
| JP | 2008-68327 | 3/2008 |
| JP | 2009-154285 | 7/2009 |
| JP | 2009-238818 | 10/2009 |

OTHER PUBLICATIONS

PAJ and Machine Translation of JP11-033890 issued Feb. 9, 1999 (previously submitted with IDS on Aug. 15, 2014).

PAJ and Machine Translation of JP 2008-36784 issued Feb. 21, 2008 ( previously submitted with IDS on Aug. 15, 2014).

* cited by examiner

POLISHING LOAD: 1200g
SUBSTRATE ROTATION SPEED: 500rpm
TAPE SENDING SPEED: 10mm/min
FLOW RATE OF POLISHING LIQUID: 500ml/min POLISHING LOAD: 24g
SUBSTRATE ROTATION SPEED: 75rpm
TAPE SENDING SPEED: 10mm/min
FLOW RATE OF POLISHING LIQUID: 500ml/min

METHOD OF POLISHING A SUBSTRATE USING A POLISHING TAPE HAVING FIXED ABRASIVE

BACKGROUND OF THE INVENTION

1. Field of the Invention

The present invention is related to a method of polishing a substrate using a polishing tape having a fixed abrasive, and more particularly to a method of polishing a peripheral portion of a substrate using the polishing tape.

2. Description of the Related Art

In semiconductor device fabrication, various materials are deposited in the form of film on a wafer repeatedly to constitute a multilayer structure. This multilayer structure is formed not only on a surface of the wafer, but also on a peripheral portion of the wafer. The peripheral portion of the wafer is a region which is not used for products. It is necessary to remove a film on the peripheral portion, because the film on the peripheral portion would be peeled off during transporting of the wafer and would then adhere to device regions on the wafer, causing a lowered yield. Thus, in order to remove the film on the peripheral portion of the wafer, polishing of the peripheral portion is performed, as disclosed in Japanese laid-open patent publication No. 2001-345294.

In polishing of the wafer having the aforementioned multilayer structure, there exists a process of selectively removing only an upper film. In such a process, it is necessary to selectively remove only the upper film by polishing it, without removing a lower film lying beneath the upper film.

A polishing method using a polishing tape is widely known as a method of polishing a peripheral portion of a wafer. For example, Japanese laid-open patent publication No. 2003-163188 discloses a method of polishing a peripheral portion of a substrate using a polishing tape having a fixed abrasive. However, use of such a polishing tape may roughen a surface of the substrate as a result of contact with the fixed abrasive.

Japanese laid-open patent publication No. 2004-103825 discloses a method of polishing a peripheral portion of a substrate by bringing a polishing cloth into contact with the peripheral portion while rotating the substrate and supplying a polishing liquid containing abrasive grains onto the substrate. In this method, the abrasive grains are suspended in the polishing liquid, i.e., in a loose state, and therefore less likely to make polishing scratches on the surface of the substrate. However, the loose abrasive grains may adhere to semiconductor devices on the substrate due to the rotation of the substrate. In order to remove such abrasive grains, it is necessary to wash the substrate with a powerful cleaning liquid after polishing of the substrate. Moreover, use of such a powerful cleaning liquid is not allowed in some processes.

In contrast, the above-described polishing method using the polishing tape having the fixed abrasive does not need using such a powerful cleaning liquid, because a polishing liquid (slurry) is not supplied to the substrate. Therefore, this polishing method is more suitable for the fabrication of the semiconductor devices. However, since an area to be polished in the peripheral portion of the substrate is small, a narrow polishing tape is necessarily used. As a result, a polishing rate decreases. In order to improve the polishing rate, a polishing tape using diamond abrasive grains may be used. However, as described previously, use of the diamond abrasive grains could roughen a surface of the substrate. In order to avoid such a rough surface, it is necessary to perform multistep polishing using multiple polishing tapes having small abrasive grains with different sizes. However, such multistep polishing takes a long time and therefore a polishing time in its entirety becomes long. As a result, a process efficiency is lowered.

SUMMARY OF THE INVENTION

The present invention has been made in order to solve the above drawbacks. It is therefore an object of the present invention to provide a high-efficient polishing method capable of selectively removing only an upper film on a lower layer without causing damages to devices on a substrate, and capable of reducing polishing scratches.

One aspect of the present invention provides a method of polishing a peripheral portion of a substrate. The method includes: causing sliding contact between the peripheral portion of the substrate and a polishing tape; and supplying a polishing liquid onto the polishing tape contacting the peripheral portion of the substrate. The polishing tape includes a base tape and a fixed abrasive formed on the base tape, and the polishing liquid is an alkaline polishing liquid containing an alkaline chemical and an additive including molecules that cause steric hindrance.

In a preferred aspect of the present invention, the causing sliding contact between the peripheral portion of the substrate and the polishing tape comprises causing sliding contact between the peripheral portion of the substrate and the polishing tape while sending the polishing tape to the substrate, and a supply point of the polishing liquid on the polishing tape is located upstream of a contact point between the polishing tape and the substrate with respect to a traveling direction of the polishing tape.

In a preferred aspect of the present invention, the supplying of the polishing liquid comprises supplying the polishing liquid onto the polishing tape contacting the peripheral portion of the substrate, while supplying a protective fluid onto a surface of the substrate so as to cover the surface of the substrate.

In a preferred aspect of the present invention, the supplying of the polishing liquid comprises supplying the polishing liquid from a position adjacent to the polishing tape onto the polishing tape contacting the peripheral portion of the substrate.

In a preferred aspect of the present invention, the base tape is made of nonwoven fabric, and the fixed abrasive includes a binder and ceria abrasive grains or silica abrasive grains fixed to the nonwoven fabric by the binder.

In a preferred aspect of the present invention, the supplying of the polishing liquid comprises supplying the polishing liquid from a back side of the polishing tape onto the polishing tape contacting the peripheral portion of the substrate.

In a preferred aspect of the present invention, the causing sliding contact between the peripheral portion of the substrate and the polishing tape comprises pressing the polishing tape against the peripheral portion of the substrate using a back pad from the back side of the polishing tape while rotating the substrate, and the supplying of the polishing liquid comprises supplying the polishing liquid onto a back surface of the polishing tape through the back pad from right behind a contact point between the polishing tape and the substrate.

In a preferred aspect of the present invention, the supplying of the polishing liquid comprises supplying the polishing liquid from a front side of the polishing tape onto the polishing tape contacting the peripheral portion of the substrate.

In a preferred aspect of the present invention, a polishing load of the polishing tape on the peripheral portion of the substrate is created by a tension of the polishing tape.

In a preferred aspect of the present invention, the polishing load is not more than 1 N.

In a preferred aspect of the present invention, the causing of the sliding contact comprises causing sliding contact between the peripheral portion of the substrate and the polishing tape inclined obliquely with respect to the peripheral portion.

In a preferred aspect of the present invention, the substrate has a lower layer and an upper film formed on the lower layer, the molecules has a property of being adsorbed onto the lower layer, and polishing of the lower layer does not substantially progress after the upper film is removed by polishing.

Another aspect of the present invention provides a method of polishing a peripheral portion of a substrate. The method includes: causing sliding contact between the peripheral portion of the substrate and a polishing tape; and supplying a polishing liquid from a back side of the polishing tape onto the polishing tape contacting the peripheral portion of the substrate. The polishing tape includes a base tape and a fixed abrasive formed on the base tape.

Still Another aspect of the present invention provides an apparatus for polishing a peripheral portion of a substrate. The apparatus includes: a polishing tape; a substrate holding mechanism configured to rotate the substrate about its own axis; a polishing head configured to bring the polishing tape into contact with the peripheral portion of the substrate; and a polishing liquid supply mechanism configured to supply a polishing liquid to the polishing tape contacting the peripheral portion of the substrate. The polishing tape includes a base tape and a fixed abrasive formed on the base tape, and the polishing liquid is an alkaline polishing liquid containing an alkaline chemical and an additive including molecules that cause steric hindrance.

When the molecules, having a structure that causes the steric hindrance, are adsorbed onto the lower layer, etching of the lower layer is substantially stopped. As a result, the polishing rate of the lower layer is reduced greatly, compared with the polishing rate of the upper film formed on the lower layer. Therefore, the polishing method according to the present invention can remove only the upper film, while leaving the lower layer as it is. Further, because the polishing liquid is supplied onto the polishing tape, the polishing liquid hardly contacts devices formed on the surface of the substrate. Therefore, an adverse influence on the devices can be avoided. Furthermore, an etching action of the alkaline chemical contained in the polishing liquid can remove polishing scratches created on the peripheral portion of the substrate.

DETAILED DESCRIPTION OF THE PREFERRED EMBODIMENTS

Embodiments of the present invention will be described below with reference to the drawings.

Figure 1A:
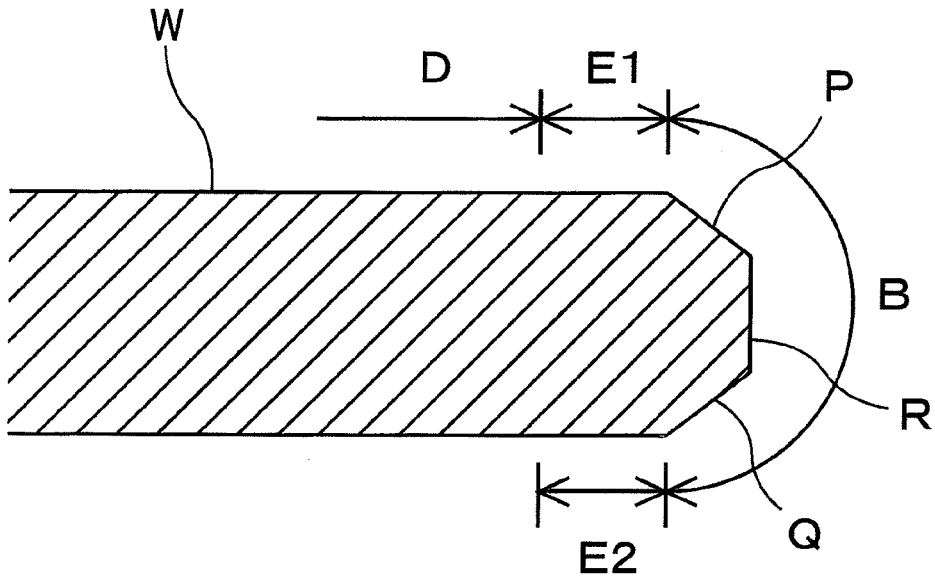
FIG. 1A and FIG. 1B are cross-sectional views each showing a peripheral portion of a substrate.
Figure 1B:
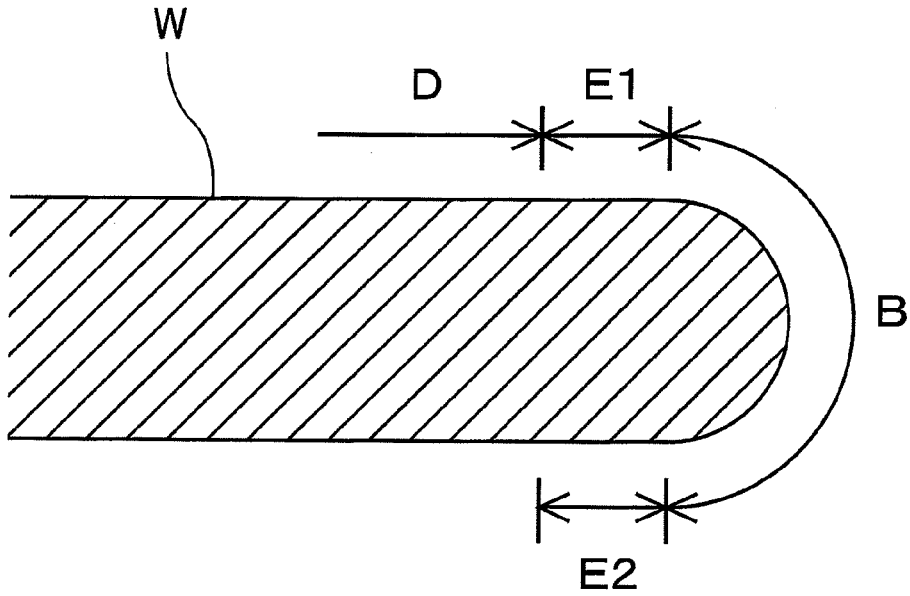

In this specification, a peripheral portion of a substrate is defined as a region including a bevel portion and near-edge portions. FIG. 1A and FIG. 1B are enlarged cross-sectional views each showing the peripheral portion of the substrate. More specifically, FIG. 1A shows a cross-sectional view of a so-called straight-type substrate, and FIG. 1B shows a so-called round-type substrate.

In the substrate W shown in FIG. 1A, the bevel portion is a portion B that is constituted by an upper slope (an upper bevel portion) P, a lower slope (a lower bevel portion) Q, and a side portion (an apex) R, all of which are located in a circumferential surface of the substrate W. In the substrate W shown in FIG. 1B, a bevel portion is a portion B having a curved cross section with a certain curvature and located in a circumferential surface of the substrate W. The near-edge portions are regions located radially inwardly of the bevel portion B and are indicated as flat portions E1 and E2 located radially outwardly of a region D where devices are formed.

Figure 2:
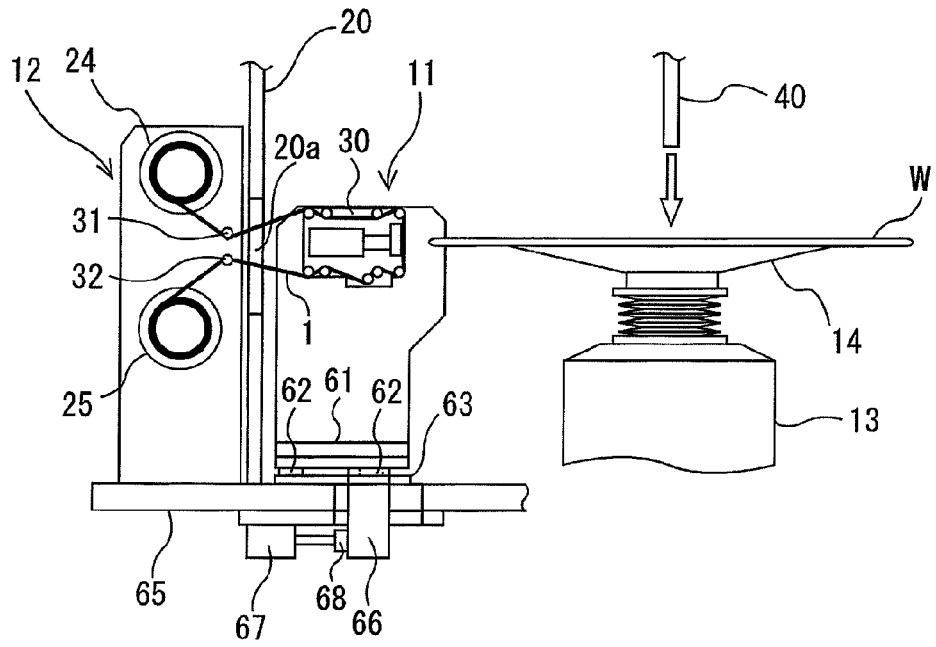
FIG. 2 is a schematic view of an example of a polishing apparatus.
Figure 3:
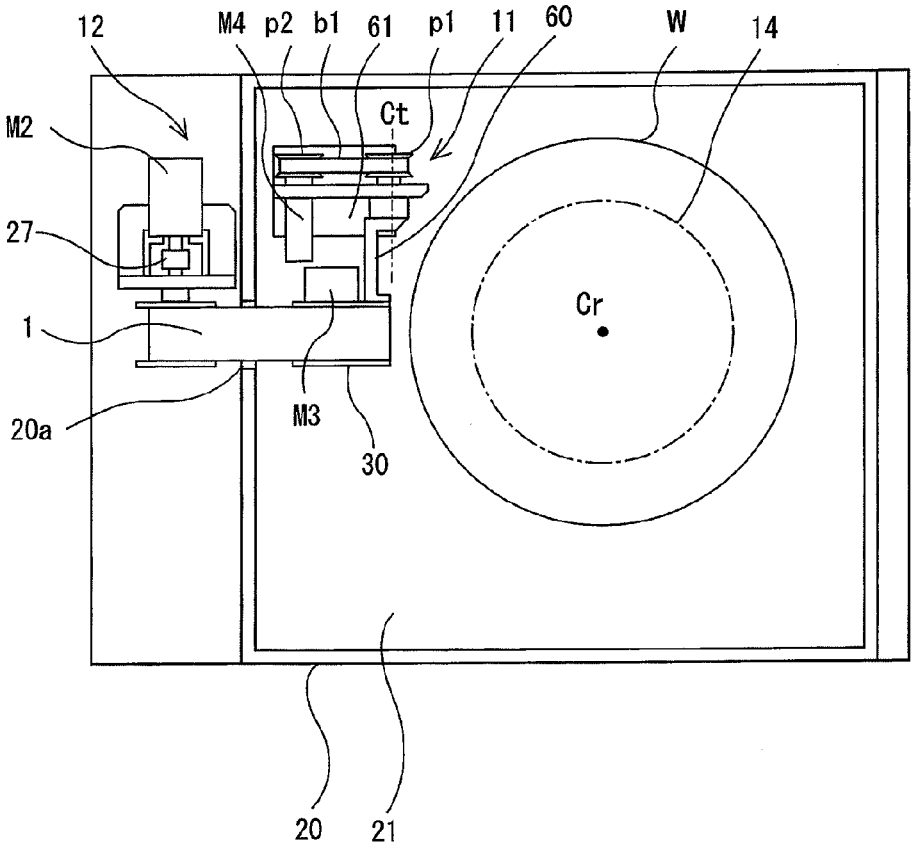
FIG. 3 is a plan view of the polishing apparatus shown in FIG. 2.

FIG. 2 is a schematic view of a polishing apparatus according to an embodiment of the present invention. FIG. 3 is a plan view of the polishing apparatus shown in FIG. 2. This polishing apparatus is suitable for polishing of the peripheral portion of the substrate (e.g., a wafer with a film formed thereon). As shown in FIG. 2 and FIG. 3, the polishing apparatus includes a substrate holding mechanism 13 configured to hold a substrate W, to be polished, horizontally and to rotate the substrate W about its own axis. This substrate holding mechanism 13 has a dish-shaped holding stage 14 configured to hold a rear surface of the substrate W by a vacuum suction and further has a motor (not shown) configured to rotate the holding stage 14.

A polishing head assembly 11 is arranged adjacent to the peripheral portion of the substrate W held by the substrate holding mechanism 13. A tape supplying and recovering mechanism 12 is provided behind the polishing head assembly 11. The polishing head assembly 11 is isolated from the tape supplying and recovering mechanism 12 by a partition 20. An interior space of the partition 20 provides a polishing room 21. The polishing head assembly 11 and the holding stage 14 are located in the polishing room 21, while the tape supplying and recovering mechanism 12 is located outside the partition 20 (i.e., outside the polishing room 21).

The tape supplying and recovering mechanism 12 includes a supply reel 24 for supplying a polishing tape 1 to the polishing head assembly 11, and a recovery reel 25 for recovering the polishing tape 1 that has been used in polishing of the substrate W. The supply reel 24 is arranged above the recovery reel 25. Motors M2 are coupled respectively to the supply reel 24 and the recovery reel 25 via couplings 27 (FIG. 3 shows only the coupling 27 and the motor M2 coupled to the supply reel 24). These motors M2 apply a predetermined tension to the polishing tape 1.

One end of the polishing tape 1 is attached to the recovery reel 25, so that the recovery reel 25 collects the polishing tape 1 that has been supplied to the polishing head assembly 11 to thereby recover the polishing tape 1. The polishing head assembly 11 has a polishing head 30 for pressing the polishing tape 1, supplied from the tape supplying and recovering mechanism 12, against the peripheral portion of the substrate W. The polishing tape 1 has a polishing surface formed by a fixed abrasive. The polishing tape 1 advances through the polishing head 30 with its polishing surface facing the substrate W.

As shown in FIG. 2, the tape supplying and recovering mechanism 12 has guide rollers 31 and 32. The polishing tape 1, to be supplied to and recovered from the polishing head assembly 11, is guided by these guide rollers 31 and 32. The polishing tape 1 is supplied to the polishing head 30 from the supply reel 24 through an opening 20*a* formed in the partition 20. The polishing tape 1 used in polishing of the substrate is recovered by the recovery reel 25 through the opening 20*a*. A nozzle 40 is provided above the substrate holding mechanism 13. This nozzle 40 is configured to supply a polishing liquid or a protective fluid onto the center of the substrate W.

Figure 4:
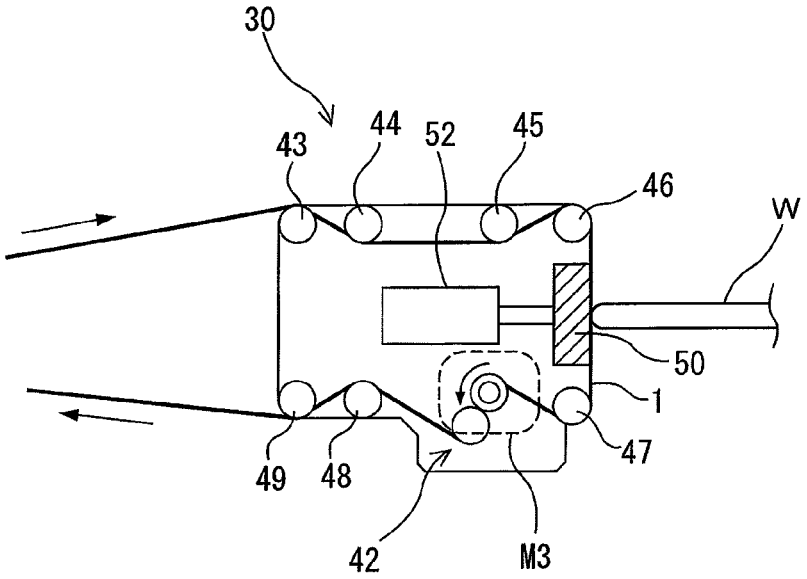
FIG. 4 is an enlarged view of a polishing head.

FIG. 4 is an enlarged view of the polishing head 30. The polishing head 30 has a tape-sending mechanism 42 configured to send the polishing tape 1 from the supply reel 24 to the recovery reel 25. The tape-sending mechanism 42 has two rollers configured to nip the polishing tape 1 and further has a motor M3 coupled to one of the two rollers. The tape-sending mechanism 42 sends the polishing tape 1 in its longitudinal direction by rotating one of the rollers by the motor M3 with the two rollers nipping the polishing tape 1. The polishing head 30 has plural guide rollers 43, 44, 45, 46, 47, 48, and 49, which are arranged to guide the polishing tape 1 such that the polishing tape 1 moves in a direction perpendicular to a tangential direction of the substrate W. The polishing tape 1 is sent downward while contacting the substrate W.

The polishing head 30 has a back pad (a pressing pad) 50 provided at a back side of the polishing tape 1 extending between the two guide rollers 46 and 47 that are arranged at a front of the polishing head 30. The guide roller 46 is located above the guide roller 47. The polishing head 30 further has an air cylinder (an actuator) 52 for moving the back pad 50 toward the substrate W. A load of the back pad 50 when pressing the polishing tape 1 against the substrate W is controlled by air pressure supplied to the air cylinder 52.

As shown in FIG. 3, the polishing head 30 is secured to one end of an arm 60, which is rotatable about an axis Ct extending parallel to a tangential direction of the substrate W. The other end of the arm 60 is coupled to a motor M4 via pulleys p1 and p2 and a belt b1. As the motor M4 rotates in a clockwise direction and a counterclockwise direction through a predetermined angle, the arm 60 rotates about the axis Ct through a predetermined angle. In this embodiment, the motor M4, the arm 60, the pulleys p1 and p2, and the belt b2 constitute a tilting mechanism for tilting the polishing head 30 with respect to the surface of the substrate W. The tilting mechanism is capable of rotating the polishing head 30 by a predetermined angle about a polishing point (i.e., a contact point between the polishing tape 1 and the substrate W) so as to change a contact angle between the polishing tape 1 and the substrate W. The tilt motion of the polishing head 30 is performed before polishing or during polishing. This tilt motion of the polishing head 30 enables the polishing tape 1 to polish, not only the bevel portion but also the near-edge portions of the substrate W.

The polishing head 30 is coupled to a movable base 61 through the tilting mechanism. This movable base 61 is movably coupled to a base plate 65 through guides 62 and rails 63. The rails 63 extend linearly in a radial direction of the substrate W held on the substrate holding mechanism 13, so that the movable base 61 can move linearly in the radial direction of the substrate W. A connection plate 66, extending through the base plate 65, is secured to the movable base 61. A linear actuator 67 is coupled to the connection plate 66 via a joint 68. This linear actuator 67 is secured to the base plate 65 directly or indirectly.

The linear actuator 67 may comprise an air cylinder or a combination of a servomotor and a ball screw. The linear actuator 67, the rails 63, and the guides 62 constitute a moving mechanism for moving the polishing head 30 linearly in the radial direction of the substrate W. Specifically, the moving mechanism is operable to move the polishing head 30 along the rails 63 closer to and away from the substrate W. On the other hand, the tape supplying and recovering mechanism 12 is fixed to the base plate 65.

FIG. 4 shows a state in which the linear actuator 67 moves the polishing head 30 forward to press the polishing tape 1 against the peripheral portion of the substrate W. In this state, the substrate W is rotated by the substrate holding mechanism 13 to cause sliding contact between the fixed abrasive of the polishing tape 1 and the peripheral portion of the substrate W, whereby the peripheral portion of the substrate W is polished. During polishing, the polishing tape 1 is sent to the substrate W at a predetermined speed by the tape-sending mechanism 42, so that new fixed abrasive is constantly used for polishing. During polishing, the nozzle 40 supplies the polishing liquid to the center of the substrate W.

Figure 5:
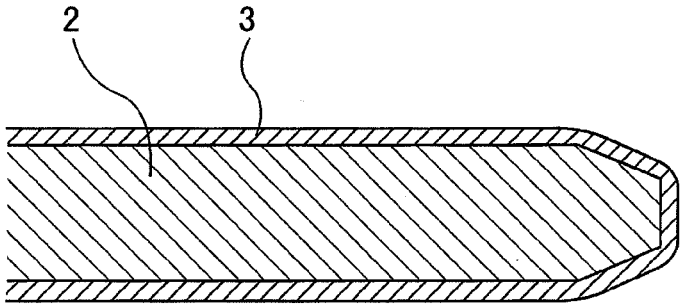
FIG. 5 is a cross-sectional view schematically showing an example of a substrate to be polished.
Figure 6:
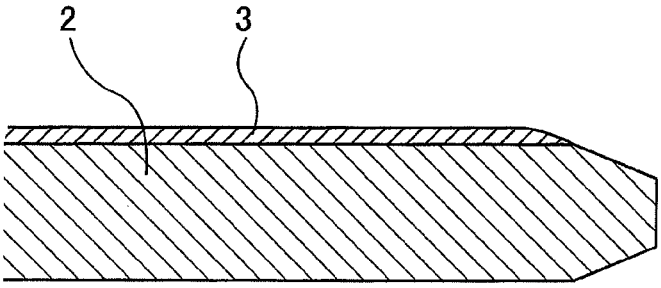
FIG. 6 is a cross-sectional view schematically showing an example of the substrate that has been polished.

Next, a first polishing method using the above-mentioned polishing apparatus will be described. FIG. 5 is a schematic cross-sectional view showing one example of the substrate to be polished. The substrate has a silicon wafer 2 and a film 3 formed on a surface of the silicon wafer 2. This first polishing method is, as shown in FIG. 6, a polishing method of removing only the film 3 formed in the bevel portion. The film 3 to be polished is an oxide film, a SiN film, a polysilicon film, or the like. The polishing tape and the polishing liquid to be used are such that no polishing scratches are left on the surface of the silicon wafer 2 beneath the film 3.

Specifically, a combination of the polishing tape holding ceria abrasive grains and an alkaline chemical as the polishing liquid is used for polishing the peripheral portion of the substrate. The polishing tape is basically composed of a base tape and a fixed abrasive formed on the base tape. A nonwoven fabric is used as the base tape. The nonwoven fabric is impregnated with ceria abrasive grains having a diameter of approximately 1 μm. The ceria abrasive grains are fixed to the nonwoven fabric by a binder (a binding agent made of resin or the like). Thus, the fixed abrasive includes the binder and the abrasive grains bound by the binder.

Figure 7:
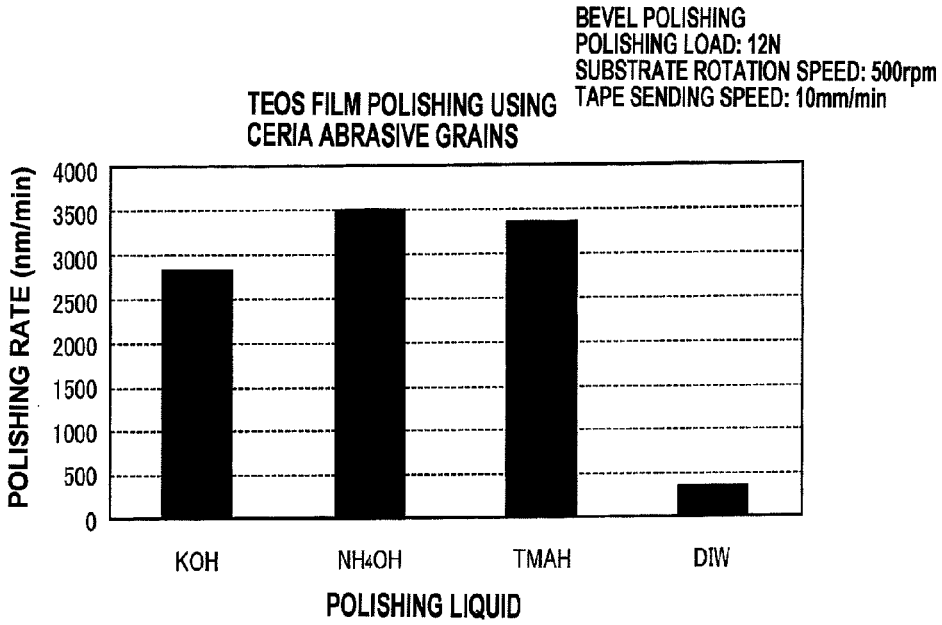
FIG. 7 is a graph showing polishing rate when polishing a TEOS film using various types of alkaline chemicals and pure water as a polishing liquid.

The alkaline chemical, such as TMAH (tetramethylammonium hydroxide), $NH_4OH$ (ammonia water), or KOH (potassium hydroxide), is used as the polishing liquid. These chemicals are strong alkaline liquid and have an etching action on the aforementioned film 3 (e.g., the oxide film, the SiN film, and the polysilicon film) and the silicon wafer 2. FIG. 7 is a graph showing polishing rate when polishing a TEOS film (tetraethoxysilane film) using various types of alkaline chemicals and pure water (DIW) as the polishing liquid. As can be seen from FIG. 7, the polishing rate is increased when using the alkaline chemicals, as compared with the case of using the pure water. This is because of the effect of the etching action of the alkaline chemicals.

In the case of polishing the substrate shown in FIG. 5 using the ceria abrasive grains, the polishing rate is lowered greatly when an exposed surface of the silicon wafer 2 appears. This is because the ceria abrasive grains are fragile under a mechanical action. Therefore, by using the ceria abrasive grains, the polishing tape can polish the substrate without changing the shape of the silicon wafer 2. Furthermore, use of the ceria abrasive grains can smooth the surface of the silicon wafer 2 without making polishing scratches on the surface of the silicon wafer 2.

Figure 8:
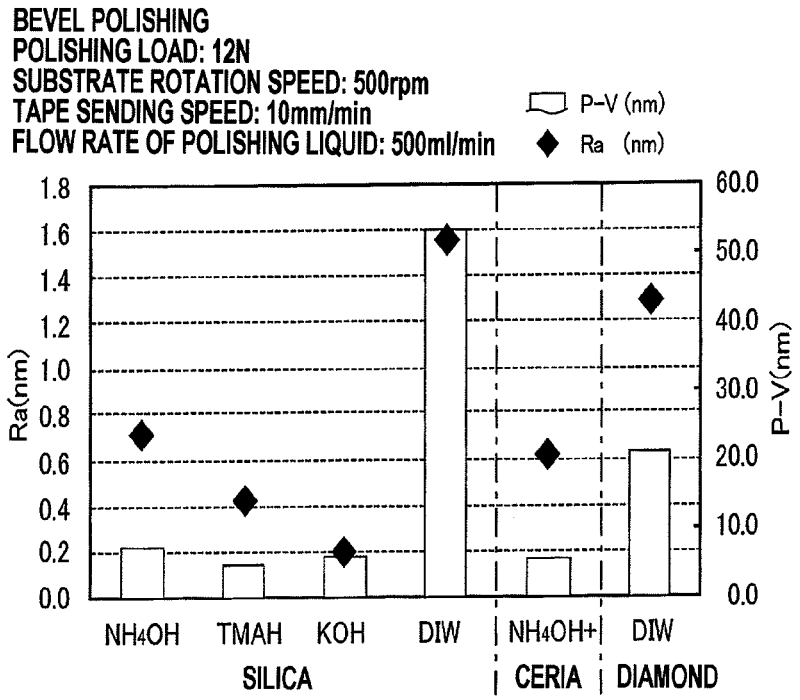
FIG. 8 is a graph showing surface roughness when silica abrasive grains, ceria abrasive grains, and diamond abrasive grains are used.

FIG. 8 is a graph showing surface roughness when the silica abrasive grains, the ceria abrasive grains, and the diamond abrasive grains are used. In the graph shown in FIG. 8, a left vertical axis represents arithmetic mean roughness (Ra), and a right vertical axis represents peak-to-valley roughness (P-V) of a profile curve. As can be seen from FIG. 8, in the case of using the silica abrasive grains, use of the alkaline chemical (e.g., TMAH, $NH_4OH$, or KOH) can reduce the surface roughness, as compared with the case of using pure water (i.e., DIW, deionized water). This is because the polishing scratches are removed by the etching action of the alkaline chemical.

Next, a second polishing method will be described. The purpose of this second polishing method is to remove the film 3 (see FIG. 5) formed on the peripheral portion of the substrate and to slightly scrape away the silicon wafer 2 beneath the film 3. The polishing tape to be used is the same as the polishing tape used in the above-described first polishing method. The polishing liquid to be used is basically the same as the polishing liquid used in the first polishing method, but an oxidizing agent, such as hydrogen peroxide, is added to the polishing liquid. By adding the oxidizing agent to the polishing liquid, the silicon wafer 2 can be scraped away slightly.

Figure 9:
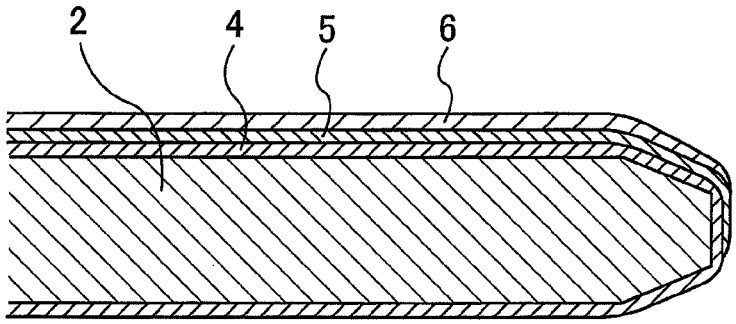
FIG. 9 is a cross-sectional view showing an example of a substrate to be polished.

Next, a third polishing method will be described. This third polishing method is suitable for polishing of a substrate having a metal film (e.g., a Cu film) for interconnects which has an adverse effect on a transistor. FIG. 9 is a cross-sectional view showing an example of a substrate used in the third polishing method. As shown in FIG. 9, a SiN film 4 serving as a barrier layer is formed on the surface of the silicon wafer 2. An oxide film 5 (e.g., a TEOS film in FIG. 9) serving as an interlayer dielectric is formed on the SiN film 4, and further a Cu film 6 serving as a metal film for forming interconnects is formed on the oxide film 5.

In the first and second polishing methods, the substrate is polished until an exposed surface of the silicon wafer 2 appears. In the third polishing method, in order to prevent the Cu film 6 from adversely affecting the transistor, the peripheral portion of the substrate is polished in a manner as not to remove the SiN film 4, serving as the barrier film to copper, from the peripheral portion of the substrate. Specifically, it is necessary to perform high-selective polishing of removing the unwanted Cu film 6 and the oxide film 5 while leaving the SiN film 4 unremoved.

Selective polishing is a polishing process of selectively removing an upper film on a lower film under the same polishing conditions (e.g., the same polishing tape, the same polishing liquid) when polishing a substrate having a multilayer structure including the upper film and the lower film. For example, high-selective polishing is a polishing process such that the polishing rate of the lower film is extremely lower than the polishing rate of the upper film. In such high-selective polishing, polishing of the lower film does not substantially progress after the upper film has been removed away. Therefore, only the upper film is selectively removed, while the lower film is hardly removed. Low-selective polishing is a polishing process such that the polishing rate of the upper film is approximately the same as the polishing rate of the lower film. In such low-selective polishing, the lower film is removed even after the upper film has been removed away.

Figure 10:
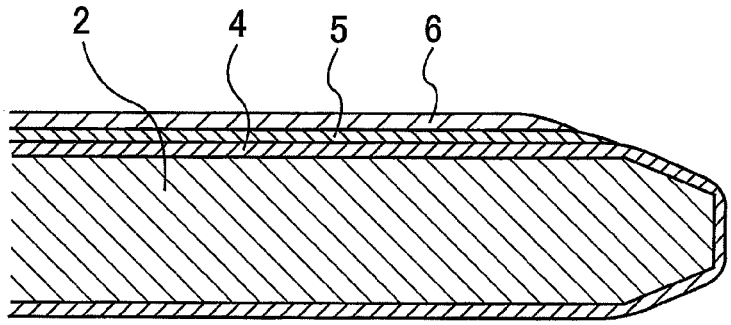
FIG. 10 is a cross-sectional view showing an example of the substrate that has been polished.

In polishing of the substrate shown in FIG. 9, only the Cu film 6 and the TEOS film 5 are removed selectively, while the underlying SiN film 4 serving as the barrier layer is not removed, as shown in FIG. 10. That is, the high-selective polishing is performed. The polishing tape to be used comprises a nonwoven fabric impregnated with ceria abrasive grains. The polishing liquid to be used is an alkaline polishing liquid containing an alkaline chemical (e.g., KOH, TMAH, or $N_4OH$) and an additive. The additive is mainly composed of molecules which cause steric hindrance and are easily be adsorbed onto the SiN film 4 serving as a lower layer of the TEOS film 5. A concentration of the additive in the polishing liquid is in a range of 0.1 to 10% wt, preferably in a range of 2 to 10% wt. A pH of the polishing liquid is maintained at about 10 by the alkaline chemical. Examples of the additive include amino acid and polyacrylic acid. More specifically, L-proline may be used as the additive.

By using the combination of the above-described polishing tape and polishing liquid, high-selective polishing can be achieved. Specifically, when the Cu film 6 and the TEOS film 5 are removed away, the polishing rate decreases extremely. The reason for using the nonwoven fabric in the polishing tape is that such polishing tape has a large area contacting the substrate and therefore a polishing load is distributed. The additive, such as L-proline, is adsorbed onto the SiN film 4 relatively easily and causes the steric hindrance. Therefore, the alkaline chemical contained in the polishing liquid hardly comes closer to the SiN film 4. As a result, polishing of the SiN film 4 progresses no further. Therefore, a ratio of the polishing rate of the TEOS film 5 to the polishing rate of the SiN film 4 (i.e., TEOS/SiN) becomes large.

Figure 11:
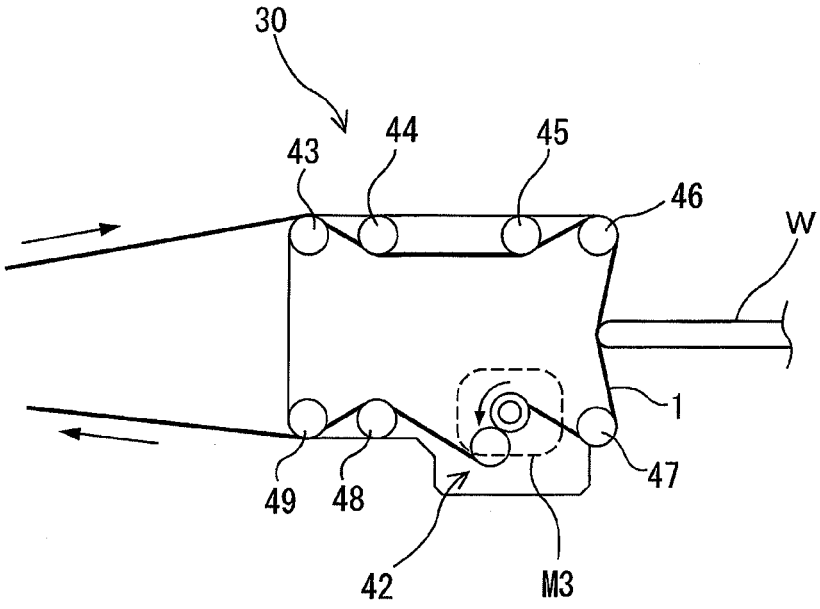
FIG. 11 is a view of a modified example of the polishing head.

Next, a fourth polishing method will be described. In this polishing method, polishing head 30 shown in FIG. 11 is used. This polishing head 30 differs from the polishing head shown in FIG. 4 in that it does not have the back pad and the air cylinder. The polishing head 30 used in this polishing method is configured to apply the polishing load to the substrate W only by the tension of the polishing tape 1. This is for the purpose of increasing the area of the polishing tape 1 contacting the substrate W so as to distribute the polishing load. This polishing method utilizing the tension of the polishing tape 1 can reduce the polishing load, as compared with the polishing method using the back pad 50 (see FIG. 4). Therefore, high-selective polishing can be achieved. In this polishing method, the same polishing tape and the same polishing liquid as those in the first to third polishing methods can be used.

The polishing tape 1 that has been used in polishing is collected by the recovery reel 25. While the polishing tape is collected, the tension is applied to the polishing tape 1 upstream of the polishing head 30 by the motor M2 (see FIG. 3) coupled to the supply reel 24. In this manner, it is possible to regulate the polishing load on the substrate W by the motor M2 coupled to the supply reel 24. For example, the polishing load is set to 1 N or less.

The polishing load can be further regulated by a relative position between the substrate W and the two guide rollers 46 and 47 located at the front of the polishing head 30. For example, the forefront of the guide rollers 46 and 47 may be located radially inwardly of the peripheral portion of the substrate W by a predetermined distance (e.g., in a range of 0 to 1 mm).

Figure 12A:
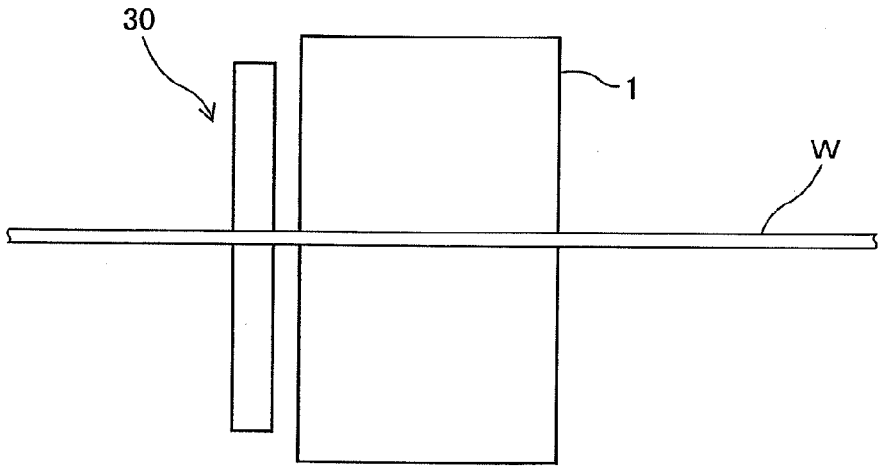
FIG. 12A is a view showing a polishing tape advancing in a direction perpendicular to a peripheral portion of a substrate.

Next, a fifth polishing method will be described. This polishing method provides a method capable of further increasing the contact area of the polishing tape. In the typical polishing method, the polishing tape 1 travels in a direction perpendicular to the peripheral portion of the substrate W, as shown in FIG. 12A. However, since the substrate W is round, the polishing tape 1 contacts the substrate W at a small area. This makes it difficult to polish the peripheral portion of the substrate W with a small load. In order to increase the contact area of the polishing tape 1, it is desirable to place the polishing tape 1 in contact with the substrate W along the peripheral portion of the substrate W. However, in this method, the polishing tape 1 is bent in a cylindrical shape, which allows the polishing tape 1 to contact only the outermost apex (see the symbol R in FIG. 1A). As a result, the polishing tape 1 cannot polish the entire bevel portions and the near-edge portions.

Figure 12B:
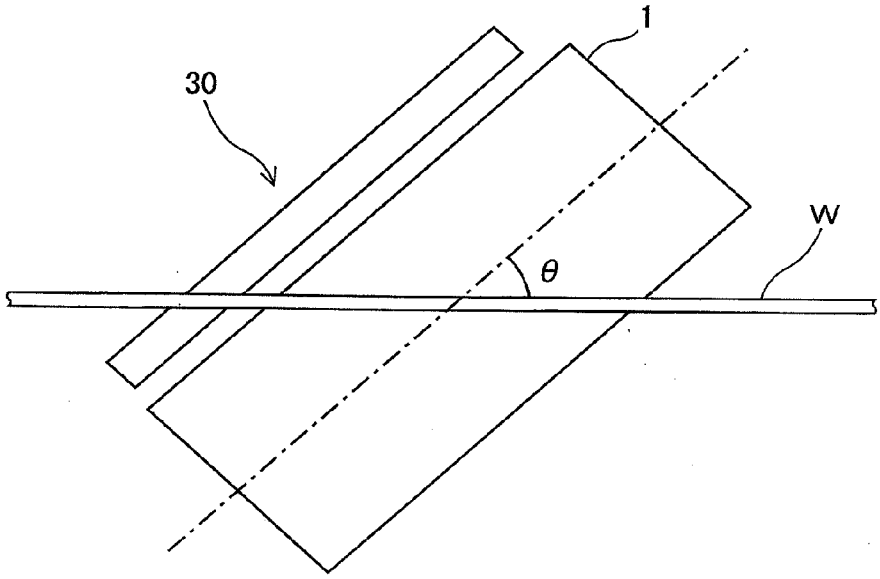
FIG. 12B is a view showing a polishing tape advancing in an oblique direction with respect to the peripheral portion of the substrate.

Thus, in this polishing method, the polishing tape 1 is arranged so as to contact the peripheral portion of the substrate W obliquely, as shown in FIG. 12B. As with the fourth polishing method, the polishing head 30 with no back pad and no air cylinder is used. An angle θ of the polishing tape 1 with respect to the peripheral portion of the substrate W is in a range of 1 to 89 degrees. In FIG. 12B, the angle θ of the polishing tape 1 is about 45 degrees. According to this polishing method in which the travel direction of the polishing tape 1 is oblique with respect to the peripheral portion of the substrate W, the width of the polishing tape 1 contributing to polishing of the substrate W can be increased. Therefore, the polishing load is lowered and more highly selective polishing can be performed. Further, because the polishing head 30 can be tilted, the peripheral portion of the substrate W in its entirety can be polished. Furthermore, it is possible to selectively polish a desired region in the peripheral portion of the substrate W by tilting the polishing head 30 at a predetermined angle with respect to the surface of the substrate W. This fifth polishing method is a modified example of the fourth polishing method and may be applied to the above-described first to third polishing methods.

Next, a sixth polishing method will be described. In the previously-described polishing apparatus shown in FIG. 2, the polishing liquid is supplied onto the center of the upper surface of the substrate W from the nozzle 40. In the sixth polishing method, the polishing liquid is supplied directly to the polishing tape 1 when contacting the peripheral portion of the substrate W. More specifically, the polishing liquid is supplied to the polishing tape 1 from the back side of the polishing tape 1 supported by the polishing head 30.

Figure 13:
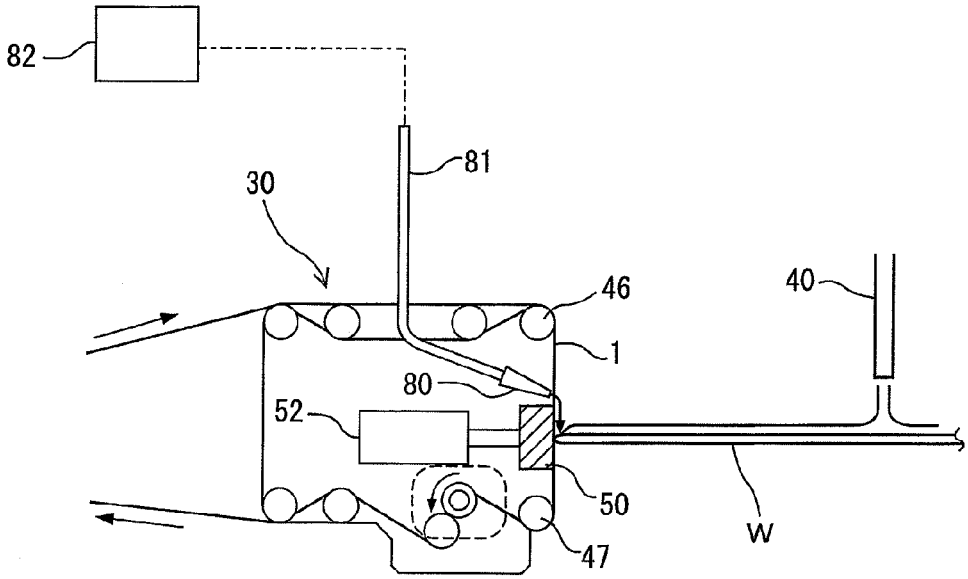
FIG. 13 is a schematic view illustrating a method of supplying a polishing liquid from a back side of the polishing tape.

As shown in FIG. 13, a polishing liquid supply nozzle 80 is provided above the back pad 50 of the polishing head 30. This polishing liquid supply nozzle 80 has a liquid supply mouth that is adjacent to a back surface of the polishing tape 1 supported by the polishing head 30. A supply point of the polishing liquid on the polishing tape 1 is located upstream of the polishing point (i.e., a contact point between the polishing tape 1 and the substrate W) with respect to the travel direction of the polishing tape 1. The polishing liquid supply nozzle 80 is coupled to a polishing liquid supply source 82 via a conduit 81. The polishing liquid supply nozzle 80, the conduit 81, and the polishing liquid supply source 82 constitute a polishing liquid supply mechanism for supplying the polishing liquid to the polishing tape 1.

The polishing liquid supply nozzle 80 is provided on the polishing head 30 integrally, so that the polishing liquid supply nozzle 80 is tilted together with the tilt motion of the polishing head 30. The polishing liquid is supplied onto the back surface of the polishing tape 1 from the polishing liquid supply nozzle 80 and passes through the polishing tape 1 to reach the front-side polishing surface. The polishing tape 1 to be used in this method has a structure that allows the polishing liquid to pass (or permeate) therethrough (i.e, is porous). For example, a polishing tape using a nonwoven fabric may be used as the polishing tape 1.

The advantages of the method of supplying the polishing liquid from behind the polishing tape 1 are that a supply position of the polishing liquid is substantially constant regardless of the tilt motion of the polishing head 30 and that the polishing liquid can be supplied directly to the peripheral portion of the substrate W while covering the devices on the substrate W with the protective fluid. Pure water is typically used as the protective fluid for the devices. In this case, the nozzle 40 shown in FIG. 2 is used as a protective fluid supply nozzle. The protective fluid supplied from the protective fluid supply nozzle 40 covers the entire surface of the substrate W to thereby protect the devices on the substrate W from the polishing liquid and the polishing debris.

Figure 14:
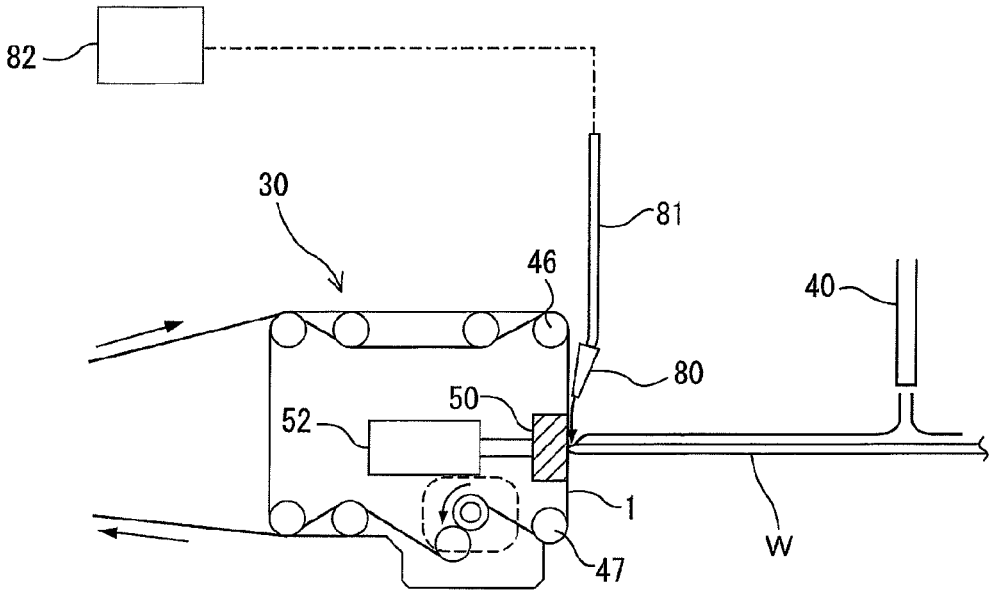
FIG. 14 is a schematic view illustrating a method of supplying a polishing liquid from a front side of the polishing tape.

FIG. 14 is a view illustrating an example of a method of supplying the polishing liquid onto the polishing tape 1 from the front side thereof. In this example, the polishing liquid supply nozzle 80 is arranged adjacent to the polishing surface of the polishing tape 1 held by the polishing head 30, as shown in FIG. 14. The polishing liquid is supplied directly to the polishing surface from the front side of the polishing tape 1. The supply point of the polishing liquid is located upstream of the polishing point (i.e., the contact point between the polishing tape 1 and the substrate W) with respect to the travel direction of the polishing tape 1.

The polishing liquid supply nozzle 80 is coupled to the polishing liquid supply source 82 through the conduit 81. The polishing liquid supply nozzle 80, the conduit 81, and the polishing liquid supply source 82 constitute the polishing liquid supply mechanism for supplying the polishing liquid to the polishing tape 1. In this example also, the nozzle 40 is used as the protective fluid supply nozzle.

The polishing liquid supply nozzle 80 is not connected to the polishing head 30. The polishing liquid supply nozzle 80 is fixed in its position. Therefore, the angle of the tilt motion of the polishing head 30 is restricted. On the other hand, this supply method is advantageous in that the polishing liquid is less likely to be diluted with the protective fluid because the polishing liquid is directly supplied to the polishing surface of the polishing tape 1. In addition, the polishing tape 1 is not required to have the structure for allowing the polishing liquid to pass therethrough.

Figure 15:
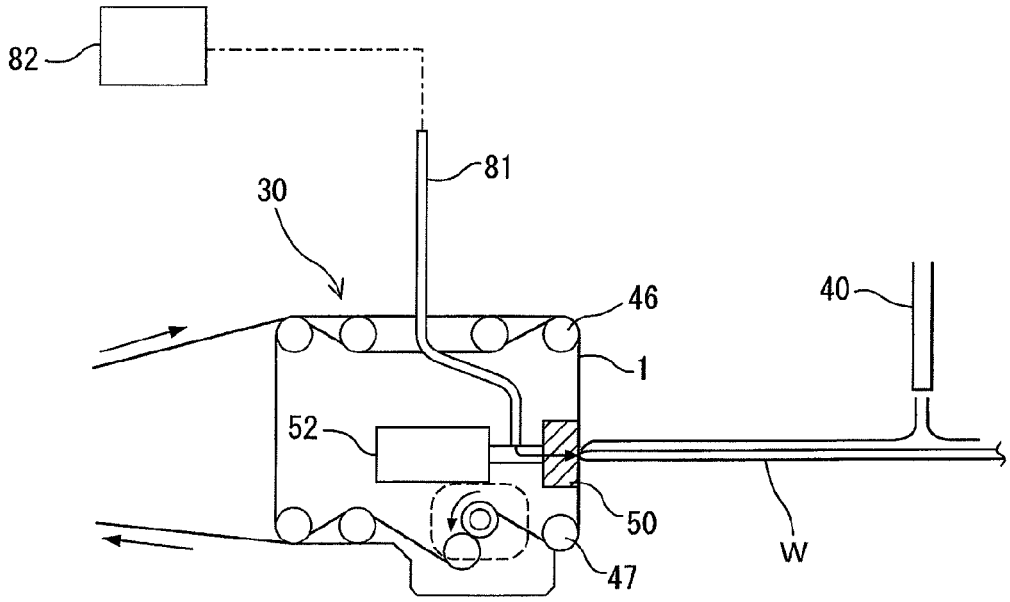
FIG. 15 is a schematic view illustrating another method of supplying the polishing liquid from the back side of the polishing tape.

FIG. 15 is a view illustrating another example of the method of supplying the polishing liquid to the polishing tape 1 from the back side thereof. In this example, conduit 81 for conveying the polishing liquid to the back pad 50 is provided on the polishing head 30, as shown in FIG. 15. The conduit 81 is coupled to a rod of the air cylinder 52, so that the polishing liquid is supplied into the back pad 50 through the rod. The conduit 81 may be directly coupled to the back pad 50. The back pad 50 is made of porous material which can permit the polishing liquid to pass (or permeate) therethrough. The polishing liquid supply source 82, the conduit 81, and the porous back pad 50 constitute the polishing liquid supply mechanism for supplying the polishing liquid to the polishing tape 1. In this example also, the nozzle 40 is used as the protective fluid supply nozzle.

With this configuration, the polishing liquid can be supplied from a pressing part of the back pad 50. Specifically, the polishing liquid is supplied to the back surface of the polishing tape 1 from right behind the polishing point of the substrate W. Unlike the example shown in FIG. 14, this polishing method has an advantage that the angle of the tilt motion of the polishing head 30 is not restricted. On the other hand, this method is not suitable for low-load polishing using a polishing load of 1 N or less, because the polishing load applied by the back pad 50 should be large to some degree. Further, the polishing tape 1 is required to have the structure that permits the polishing liquid to pass (or permeate) therethrough.

Figure 16:
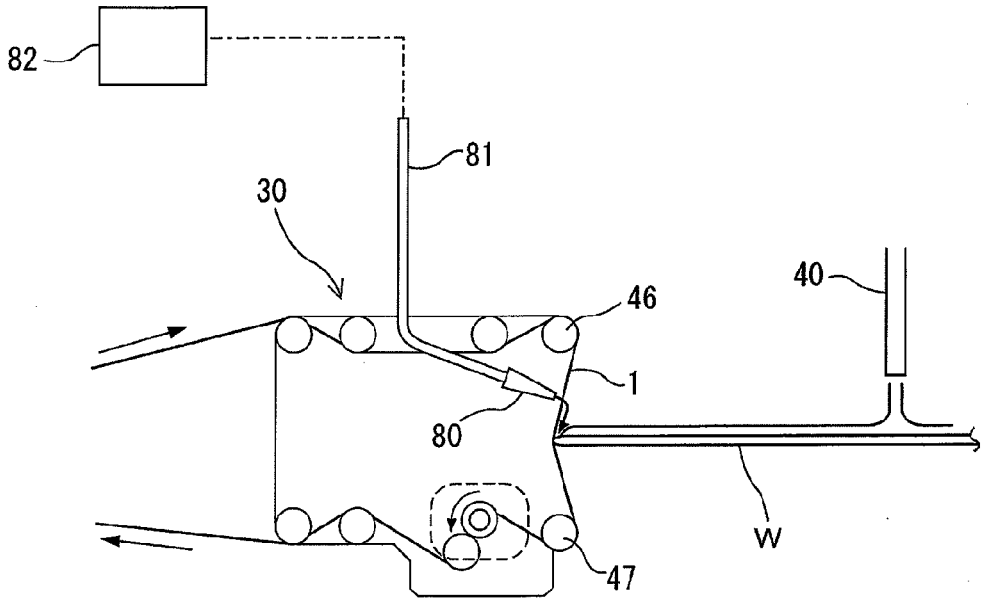
FIG. 16 is a schematic view illustrating still another method of supplying the polishing liquid from the back side of the polishing tape.

FIG. 16 is a view illustrating still another example of the method of supplying the polishing liquid to the polishing tape 1 from the back side thereof. In this example, the back pad and the air cylinder are not provided. The polishing load on the substrate W is created only by the tension of the polishing tape 1. The structure and the arrangement of the polishing liquid supply mechanism, which includes the polishing liquid supply nozzle 80, the conduit 81, and the polishing liquid supply source 82, are the same as those of the polishing liquid supply mechanism shown in FIG. 13. In this example also, the nozzle 40 is used as the protective fluid supply nozzle. Further, the polishing tape 1 to be used has the structure that permits the polishing liquid to pass therethrough. For example, the nonwoven fabric may be used in the polishing tape 1. The polishing head 30 shown in FIG. 16 is capable of polishing the peripheral portion of the substrate W by the polishing tape 1 at a small polishing load, as well as the polishing head shown in FIG. 11. Therefore, high-selective polishing can be realized. For example, the polishing load is set to 1 N or less.

The polishing liquid supply mechanisms shown in FIG. 13 through FIG. 16 can be applied to the first to fifth polishing methods described above.

Figure 17:
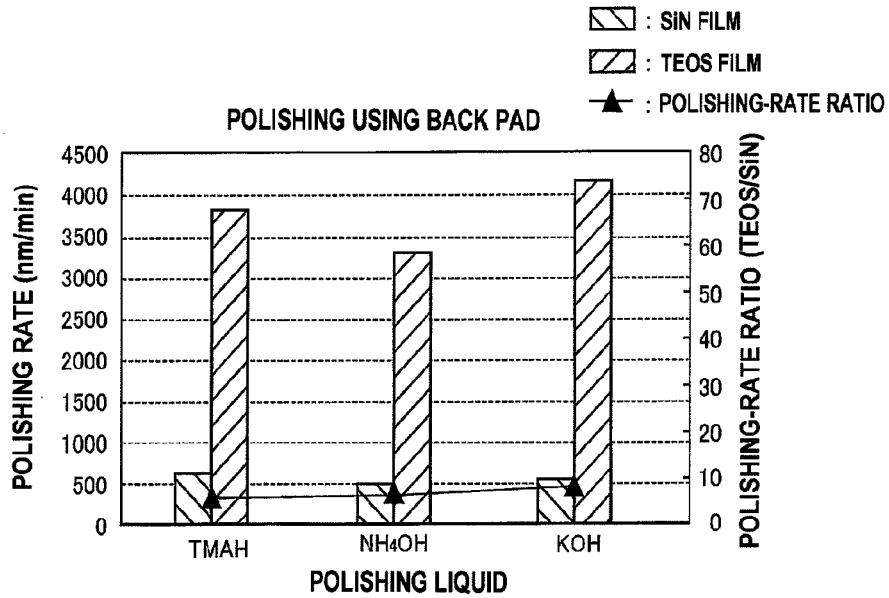
FIG. 17 is a graph showing the polishing rate when polishing the substrate shown in FIG. 9 according to a polishing method using a back pad.
Figure 18:
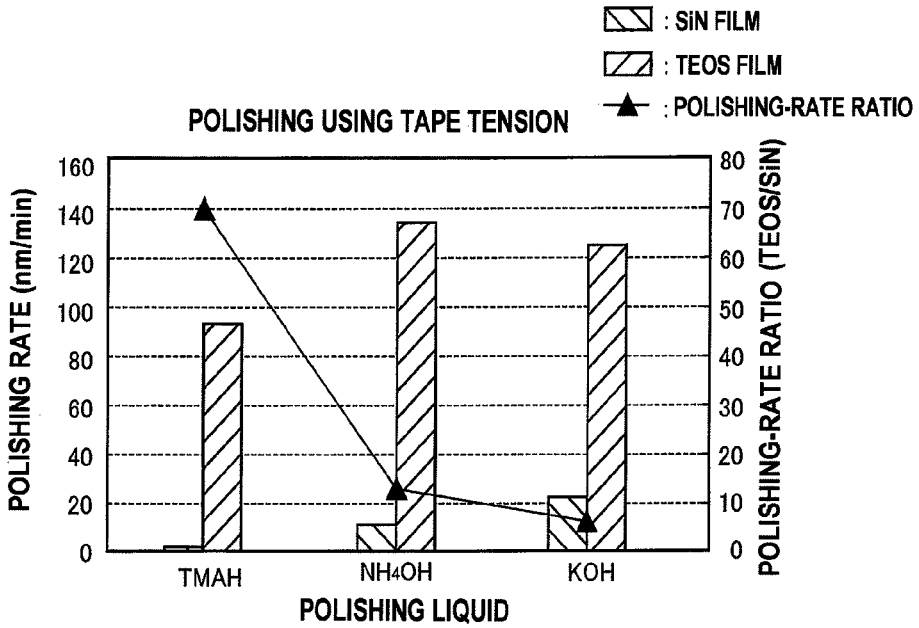
FIG. 18 is a graph showing the polishing rate when polishing the substrate shown in FIG. 9 according to a polishing method using a tension of the polishing tape.
Figure 19:
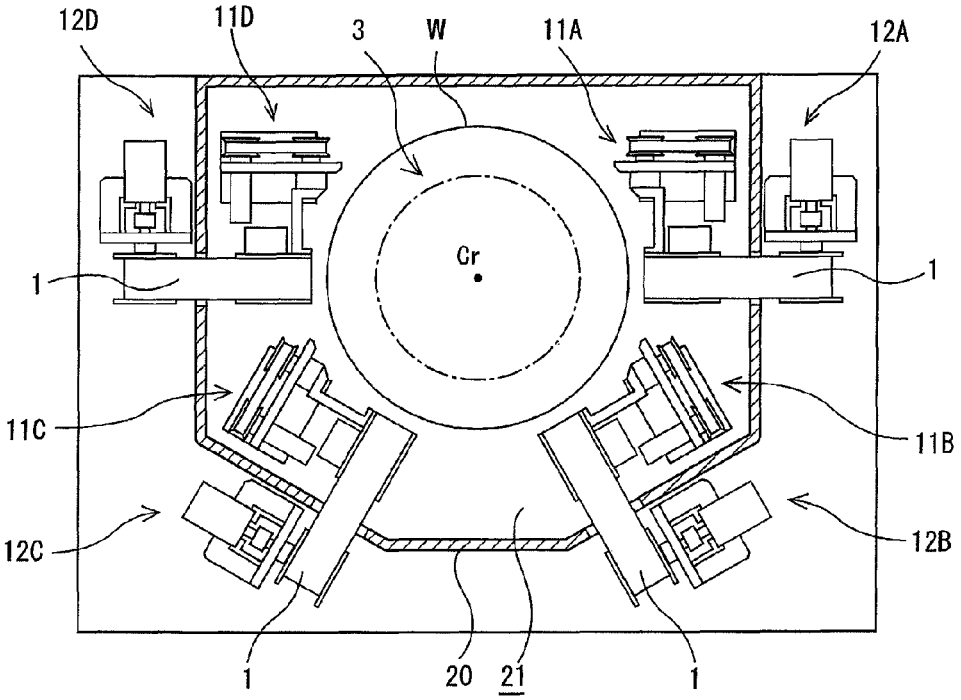
FIG. 19 is a plan view of a polishing apparatus having multiple polishing head assemblies.

FIG. 17 is a graph showing the polishing rate when polishing the substrate shown in FIG. 9 according to the polishing method using the back pad. FIG. 18 is a graph showing the polishing rate when polishing the substrate shown in FIG. 9 according to the polishing method using the tension of the polishing tape. In FIG. 18 and FIG. 19, a left vertical axis represents polishing rate (nm/min), and a right vertical axis represents ratio of the polishing rate of the TEOS film to the polishing rate of the SiN film.

As can be seen from FIG. 17 and FIG. 18, the polishing method utilizing the tension of the polishing tape can polish the peripheral portion of the substrate at a smaller polishing load. Further, use of the polishing method utilizing the tension of the polishing tape results in a larger ratio of the polishing rate of the TEOS film to the polishing rate of the SiN film. In particular, when using TMAH as the polishing liquid, the polishing-rate ratio increases significantly. Thus, by determining the polishing conditions (e.g., the polishing liquid, the polishing load, the polishing tape, and the like) such that the polishing-rate ratio becomes high, high-selective polishing can be performed.

In the first polishing method through the sixth polishing method, the polishing load on the substrate may be changed during polishing of the substrate. For example, a large polishing load may be applied at an initial polishing stage so that the peripheral portion of the substrate is polished at a high polishing rate, and when a film thickness becomes small, i.e., shortly before a film is removed away, a smaller polishing load may be applied so that the peripheral portion of the substrate is polished at a low polishing rate. In this manner, high-selective polishing may be performed only when the film is removed away. With this operation, the polishing time can be shortened in its entirety, and consumption of the polishing tape, which is one of consumables, can be reduced.

A type of polishing tape may also be changed during polishing of the substrate. For example, a polishing tape having the diamond abrasive grains may be used to polish the peripheral portion of the substrate at the initial polishing stage, and a polishing tape having the silica abrasive grains may be used to perform finish-polishing of the peripheral portion of the substrate at a final polishing stage. In this case where various types of polishing tapes are used, it is preferable to use a polishing apparatus having multiple polishing head assemblies as shown in FIG. 19.

The polishing apparatus shown in FIG. 19 has plural polishing head assemblies 11A, 11B, 11C, and 11D and plural tape supplying and recovering mechanisms 12A, 12B, 12C, and 12D, which have the same structures as the polishing head assembly 11 and the tape supplying and recovering mechanism 12, respectively. The polishing head assemblies 11A, 11B, 11C, and 11D and the tape supplying and recovering mechanisms 12A, 12B, 12C, and 12D are arranged so as to surround the substrate W held by the substrate holding mechanism 13. The polishing apparatus having such structures can perform multistep polishing processes sequentially using various types of polishing tapes. For example, the first polishing head assembly 11A may polish the peripheral portion of the substrate W using the polishing tape having the diamond abrasive grains and then the second polishing head assembly 11B may polish the peripheral portion of the substrate W using the polishing tape having the silica abrasive grains.

The previous description of embodiments is provided to enable a person skilled in the art to make and use the present invention. Moreover, various modifications to these embodiments will be readily apparent to those skilled in the art, and the generic principles and specific examples defined herein may be applied to other embodiments. Therefore, the present invention is not intended to be limited to the embodiments described herein but is to be accorded the widest scope as defined by limitation of the claims and equivalents.

What is claimed is:

1. A method of polishing a peripheral portion of a substrate, said method comprising:

causing sliding contact between the peripheral portion of the substrate and a polishing tape; and supplying a polishing liquid onto the polishing tape contacting the peripheral portion of the substrate, wherein the polishing tape includes a base tape and a fixed abrasive formed on the base tape, and wherein the polishing liquid is an alkaline polishing liquid containing an alkaline chemical and an additive including molecules that cause steric hindrance.

2. The method according to claim 1, wherein:

said causing sliding contact between the peripheral portion of the substrate and the polishing tape comprises causing sliding contact between the peripheral portion of the substrate and the polishing tape while sending the polishing tape to the substrate; and a supply point of the polishing liquid on the polishing tape is located upstream of a contact point between the polishing tape and the substrate with respect to a traveling direction of the polishing tape.

3. The method according to claim 1, wherein said supplying of the polishing liquid comprises supplying the polishing liquid onto the polishing tape contacting the peripheral portion of the substrate, while supplying a protective fluid onto a surface of the substrate so as to cover the surface of the substrate.

4. The method according to claim 1, wherein said supplying of the polishing liquid comprises supplying the polishing liquid from a position adjacent to the polishing tape onto the polishing tape contacting the peripheral portion of the substrate.

5. The method according to claim 1, wherein:

the base tape is made of nonwoven fabric; and the fixed abrasive includes a binder and ceria abrasive grains or silica abrasive grains fixed to the nonwoven fabric by the binder.

6. The method according to claim 1, wherein said supplying of the polishing liquid comprises supplying the polishing liquid from a back side of the polishing tape onto the polishing tape contacting the peripheral portion of the substrate.

7. The method according to claim 6, wherein:

said causing sliding contact between the peripheral portion of the substrate and the polishing tape comprises pressing the polishing tape against the peripheral portion of the substrate using a back pad from the back side of the polishing tape while rotating the substrate; and said supplying of the polishing liquid comprises supplying the polishing liquid onto a back surface of the polishing tape through said back pad from right behind a contact point between the polishing tape and the substrate.

8. The method according to claim 1, wherein said supplying of the polishing liquid comprises supplying the polishing liquid from a front side of the polishing tape onto the polishing tape contacting the peripheral portion of the substrate.

9. The method according to claim 1, wherein a polishing load of the polishing tape on the peripheral portion of the substrate is created by a tension of the polishing tape.

10. The method according to claim 9, wherein the polishing load is not more than 1 N.

11. The method according to claim 1, wherein said causing of the sliding contact comprises causing sliding contact between the peripheral portion of the substrate and the polishing tape inclined obliquely with respect to the peripheral portion.

12. The method according to claim 1, wherein:

the substrate has a lower layer and an upper film formed on the lower layer;

the molecules has a property of being adsorbed onto the lower layer; and polishing of the lower layer does not substantially progress after the upper film is removed by polishing.

13. A method of polishing a peripheral portion of a substrate, said method comprising:

causing sliding contact between the peripheral portion of the substrate and a porous polishing tape; and supplying a polishing liquid from a back side of the porous polishing tape so that the polishing liquid passes through the porous polishing tape to reach a front side surface of the polishing tape contacting the peripheral portion of the substrate, wherein the porous polishing tape includes a base tape and a fixed abrasive formed on the base tape.

14. The method according to claim 13, wherein a supply point of the polishing liquid on the polishing tape is located upstream of a contact point between the polishing tape and the substrate with respect to a travel direction of the polishing tape.

15. The method according to claim 13, wherein said supplying the polishing liquid comprises supplying the polishing liquid through a back pad and the polishing tape to the front-side surface of the polishing tape contacting the peripheral portion of the substrate, and wherein the back pad is disposed at the back side of the polishing tape.

16. The method according to claim 15, wherein said supplying the polishing liquid comprises supplying the polishing liquid from right behind a contact point between the polishing tape and the substrate.

17. The method according to claim 13, wherein said supplying the polishing liquid is performed while supplying a protective fluid onto a surface of the substrate so as to cover the surface of the substrate.

18. The method according to claim 13, wherein the polishing tape is a polishing tape using a nonwoven fabric.

19. An apparatus for polishing a peripheral portion of a substrate, said apparatus comprising:

a polishing tape;

a substrate holding mechanism configured to rotate the substrate about its own axis;

a polishing head configured to bring said polishing tape into contact with the peripheral portion of the substrate; and a polishing liquid supply mechanism configured to supply a polishing liquid to the polishing tape contacting the peripheral portion of the substrate, wherein the polishing tape includes a base tape and a fixed abrasive formed on the base tape, and wherein the polishing liquid is an alkaline polishing liquid containing an alkaline chemical and an additive including molecules that cause steric hindrance.

* * * * *